US007094747B2

(12) United States Patent
Geffroy et al.

(10) Patent No.: US 7,094,747 B2
(45) Date of Patent: Aug. 22, 2006

(54) PROCESS FOR CLEANING A SURFACE USING AN AQUEOUS COMPOSITION CONTAINING A DISPERSED POLYMER

(75) Inventors: Cédric Geffroy, Poitiers (FR); Marie-Pierre Labeau, Paris (FR); Eric Aubay, Le Perreux sur Marne (FR)

(73) Assignee: Rhodia Chimie, Boulogne-Billancourt Cedex (FR)

( * ) Notice: Subject to any disclaimer, the term of this patent is extended or adjusted under 35 U.S.C. 154(b) by 151 days.

(21) Appl. No.: 10/192,633

(22) Filed: Jul. 11, 2002

(65) Prior Publication Data

US 2003/0109413 A1 Jun. 12, 2003

Related U.S. Application Data

(60) Provisional application No. 60/304,100, filed on Jul. 11, 2001.

(51) Int. Cl.
*C11D 17/00* (2006.01)
*C11D 1/00* (2006.01)
*C11D 3/37* (2006.01)

(52) U.S. Cl. ..... 510/476; 510/360; 510/361; 510/438; 510/445; 510/477

(58) Field of Classification Search ..... 510/360, 510/361, 438, 445, 476, 477
See application file for complete search history.

(56) References Cited

U.S. PATENT DOCUMENTS 3,326,807 A 6/1967 Guest et al.
3,340,217 A * 9/1967 Woodruff ..... 524/811
3,544,501 A 12/1970 Fearnley et al.
3,606,989 A 9/1971 Park
4,746,455 A * 5/1988 Matsuda et al. ..... 510/337
2003/0109413 A1* 6/2003 Geffroy et al. ..... 510/475

FOREIGN PATENT DOCUMENTS

EP WO 98/00449 * 1/1998
EP 1146057 A 10/2001
FR 1416813 A 11/1965
WO 98/00449 A 1/1998
WO 00/68352 A 11/2000

* cited by examiner

*Primary Examiner*—Brian P Mruk
(74) *Attorney, Agent, or Firm*—Buchanan Ingersoll & Rooney, PC

(57) ABSTRACT

Process for enhancing the cleaning properties of an aqueous cleaning composition comprising at least one surfactant, intended for cleaning a surface which has been soiled with soiling, by adding to said cleaning composition, at least one polymer (P) comprising:

Figure 1:
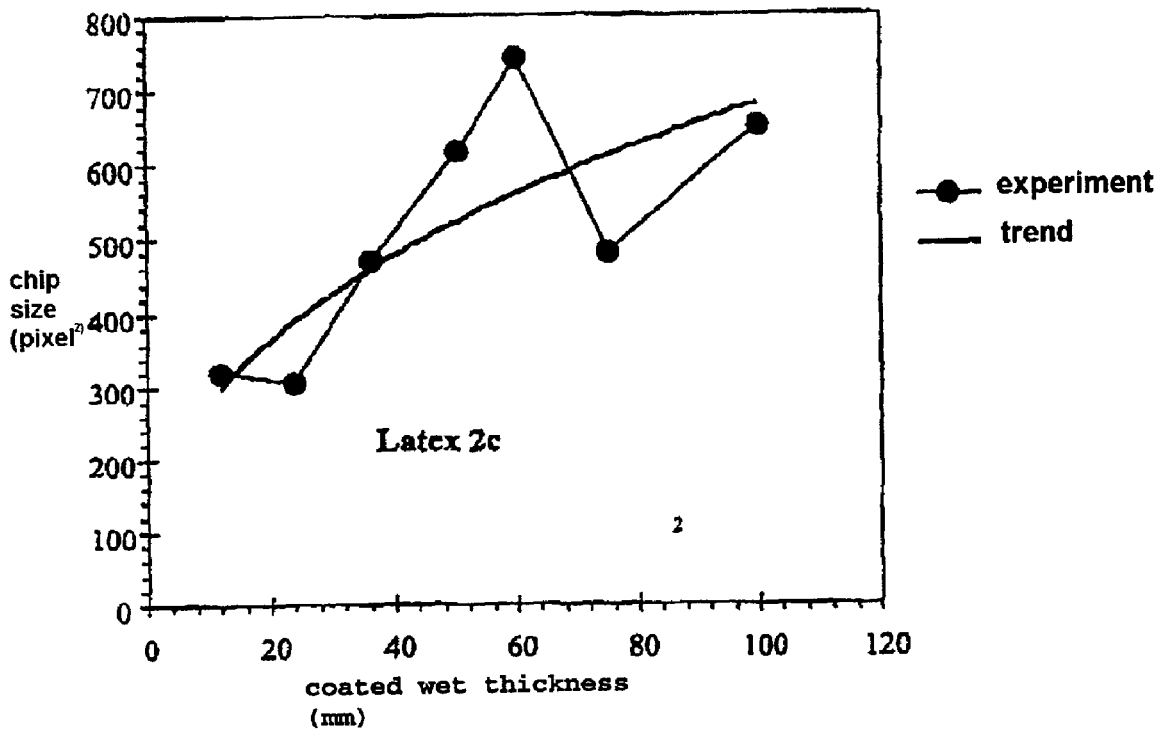

hydrophobic monomer units that are uncharged or non-ionizable at the working pH of the composition of the invention and optionally at least one hydrophilic monomer unit.

Preferably, the polymer employed is a copolymer containing sulfur-containing functions in the ionic form (preferably containing sulfonated or sulfated functions).

74 Claims, 2 Drawing Sheets

PROCESS FOR CLEANING A SURFACE USING AN AQUEOUS COMPOSITION CONTAINING A DISPERSED POLYMER

This application claims priority under 35 U.S.C. § 119 to U.S. Provisional Application No. 60/304,100 entitled PROCESS FOR CLEANING A SURFACE USING AN AQUEOUS COMPOSITION CONTAINING A NANOLATEX and filed on Jul. 11, 2001, the entire content of which is hereby incorporated by reference.

The present invention relates to a process for enhancing the cleaning properties of an aqueous composition intended for cleaning a surface which has been soiled with soiling, by adding, to said aqueous cleaning composition, at least one polymer in the form of insoluble particles. Another subject is the use, in an aqueous composition intended for cleaning a surface which has been soiled with soiling, of at least one polymer in the form of insoluble particles, as an agent for improving the removal of the soiling from the soiled surface. Another subject is a process for cleaning a surface which has been soiled with soiling. Most particularly, the polymer used is a copolymer containing sulfur-containing functions in the ionic form (preferably containing sulfonated or sulfated fractions).

Soft surfaces such as various textiles, hair, and human skin, and hard surfaces such as cement, ceramics, bricks and metals are soiled with various types of soiling which is difficult to remove; specifically, this soiling is very often bound to the support which it soils via strong chemical or electrostatic bonds which are difficult to remove. Various methods have already been proposed for encapsulating this soiling with various encapsulating products, followed by removal of the encapsulated soiling by various means such as brushing and vacuum cleaning. Unfortunately, however, the known encapsulating agents participate in and even accentuate the phenomenon of attraction of the encapsulated soiling to the soiled support.

The aim of the present invention is precisely to solve the above problem. The aim of the invention is also to propose an aqueous cleaning composition whose agent which coats/encapsulates the soiling particle is adapted to the physicochemical nature of the support to be cleaned.

This aim and others are achieved by the present invention.

A first subject of the invention consists of a process for enhancing the cleaning properties of an aqueous cleaning composition comprising at least one surfactant, which composition is intended for cleaning a surface which has been soiled with soiling, by adding to said cleaning composition, at least one polymer (P) comprising:

hydrophobic monomer units (N) that are uncharged or non-ionizable at the working pH of the composition of the invention, optionally at least one hydrophilic monomer unit (F) chosen from the following monomer units:

(F1) monomers that are cationic or potentially cationic at the working pH of said composition, (F2) monomers that are amphoteric at the working pH of said composition, (F3) monomers that are anionic or potentially anionic at the working pH of said composition, (F4) monomers that are uncharged or non-ionizable, of hydrophilic nature, at the working pH of said composition, or mixtures thereof, and optionally at least one crosslinking unit (R).

The process for cleaning a surface soiled with soiling may comprise the following steps:

a) coating the surface to be cleaned with an effective amount of aqueous cleaning composition comprising the polymer (P) which is insoluble under the working conditions in aqueous medium of said composition, b) drying the surface to evaporate the water of the composition and to generate the polymer (P) of the dispersion which forms a polymer (P)/soiling composite product, and c) optionally, removing said composite product from the surface thus cleaned.

It may be a process for cleaning carpets and rugs, more particularly made of synthetic fiber and more particularly made of polyamide and/or polyester. Needless to say, the treatment may be adapted to carpets and rugs made of natural and synthetic fiber, the natural fiber being, for example, wool, flax, hemp or silk.

It may also be a process for cleaning laundry made of natural or synthetic fiber as described above, hair, skin, hard surfaces of concrete, glass, stone, brick, ceramic, melamine, metal or wood type and other synthetic surfaces of PVP, PP, polycarbonate, polyurethane, silicone or reinforced polyester type (by glass fibers, for example).

Preferably said monomer units (N) and (F) are derived from α-β monoethylenically unsaturated monomers; preferably, said monomer units (R) are derived from diethylenically unsaturated monomers.

The average molar mass of said polymer (measured by gel permeation chromatography (GPC) THF and expressed as polystyrene equivalents) may preferably be at least 20000 g/mol.

As examples of monomers from which the hydrophobic units (N) are derived, mention may be made of:

vinylaromatic monomers such as styrene, vinyltoluene, etc., alkyl esters of α-β monoethylenically unsaturated acids such as methyl, ethyl, etc. acrylates and methacrylates, vinyl or allylic esters of saturated carboxylic acids, such as vinyl or allyl acetates, propionates or versatates, α-β monoethylenically unsaturated nitrites, such as acrylonitrile.

As examples of monomers from which the cationic or potentially cationic hydrophilic units (F1) are derived, mention may be made of:

N,N-(dialkylamino-ω-alkyl)amides of α-β monoethylenically unsaturated carboxylic acids such as N,N-dimethylaminomethyl acrylamide or methacrylamide, N,N-dimethylaminoethyl acrylamide or methacrylamide, N,N-dimethylamino-3-propyl acrylamide or methacrylamide and N,N-dimethylaminobutyl acrylamide or methacrylamide, α-β monoethylenically unsaturated amino esters, such as dimethylaminoethyl methacrylate (DMAM), dimethylaminopropyl methacrylate, di-tert-butylaminoethyl methacrylate or dipentylaminoethyl methacrylate, monomers that are precursors of amine functions, such as N-vinylformamide, N-vinylacetamide, etc., which generate primary amine functions by simple acidic or basic hydrolysis.

As examples of monomers from which the amphoteric hydrophilic units (F2) are derived, mention may be made of:

N,N-dimethyl-N-methacryloyloxyethyl-N-(3-sulfopropyl) ammonium sulfobetaine (SPE from Raschig), N,N-dimethyl-N-(2-methacrylamidoethyl)-N-(3-sulfopropyl)ammonium betaine (SPP from Raschig), 1-vinyl-3-(3-sulfopropyl)imidazolidium betaine or 1-(3-sulfopropyl)-2-vinylpyridinium betaine (SPV from Raschig), derivatives of the quaternization reaction of N-(dialkylamino-ω-alkyl)amides of α-β ethylenically unsaturated carboxylic acids, such as N,N-dimethylaminomethyl acrylamide or methacrylamide, N,N-dimethylamino-3-propyl acrylamide or methacrylamide, or ethylenically unsaturated amino esters, such as di-tert-butylaminoethyl methacrylate or dipentylaminoethyl methacrylate, with a chloroacetate of an alkali metal (in particular sodium) or of propane sultone.

As examples of monomers from which the anionic or potentially anionic hydrophilic units (F3) are derived, mention may be made of:

monomers containing at least one carboxylic function, such as α-β ethylenically unsaturated carboxylic acids or anhydrides, acrylic, methacrylic, maleic, fumaric or itaconic acids or anhydrides, N-methacroylalanine or N-acryloylhydroxyglycine, and water-soluble salts thereof, monomers containing at least one sulfur-containing function preferably sulfate or sulfonate, such as 2-sulfooxyethyl methacrylate, vinylbenzenesulfonic acid, allylsulfonic acid, 2-acrylamido-2-methylpropanesulfonic acid, sulfoethyl acrylate or methacrylate, or sulfopropyl acrylate or methacrylate, and water-soluble salts thereof, monomers containing at least one phosphonate or phosphate function, such as vinylphosphonic acid or vinyldiphosphonic acid, esters of ethylenically unsaturated phosphates such as phosphates derived from hydroxyethyl methacrylate (Empicryl 6835 from Rhodia) and those derived from polyoxyalkylene methacrylates and water-soluble salts thereof α-β monoethylenically unsaturated monomers that are precursors of anionic function(s), such as those whose hydrolysis generates carboxylate functions (tert-butyl acrylate, dimethylaminoethyl acrylate, maleic anhydride, etc.).

As examples of monomers from which the uncharged or non-ionizable hydrophilic units (F4) are derived, mention may be made of:

hydroxyalkyl esters of α-β ethylenically unsaturated acids, such as hydroxyethyl, hydroxypropyl, etc. acrylates and methacrylates, amides of α-β ethylenically unsaturated acids amides, such as acrylamide, N,N-dimethyl methacrylamide, N-methylolacrylamide, etc., α-β ethylenically unsaturated monomers bearing a water-soluble polyoxyalkylenated segment of the polyethylene oxide type, such as polyethylene oxide α-methacrylates (Bisomer S20W, S10W, etc. from Laporte) or α,ω-dimethacrylates, Sipomer BEM from Rhodia (polyoxyethylene ω-behenyl methacrylate), Sipomer SEM-25 from Rhodia (polyoxyethylene ω-tristyrylphenyl methacrylate), etc., α-β ethylenically unsaturated monomers that are precursors of hydrophilic units or segments, such as vinyl acetate, which, once polymerized, may be hydrolyzed to generate vinyl alcohol units or polyvinyl alcohol segments, α-β ethylenically unsaturated monomers of ureido type and in particular methacrylamidoethyl-2-imidazolidinone (Sipomer WAM II from Rhodia).

As examples of monomers from which the crosslinking units (R) are derived, mention may be made of:

divinylbenzene ethylene glycol dimethacrylate allyl methacrylate methylenebis(acrylamide)

glyoxalbis(acrylamide).

Said polymers (P) are in the form of insoluble particles; the diameter of said particles may range from 5 nm to 500 nm, preferably from 5 nm to 300 nm, more particularly from 5 nm to 100 nm, and even more particularly from 100 nm to 500 nm.

Aqueous dispersions (latex) of said polymers (P) may be obtained in a known manner by free-radical polymerization in aqueous medium of ethylenically unsaturated monomers. Processes for obtaining nanoparticulate latices of small diameter are described in Colloid Polym. Sci. 266:462–469 (1988) and in Journal of Colloid and Interface Science. Vol. 89, No. 1, September 1982, pages 185 et seq. One method for preparing latices of particles with a mean size of less than 100 nm, in particular with a mean size ranging from 1 to 60 nm and most particularly from 5 to 40 nm, is described in EP-A-644 205.

The choice and relative amounts of the monomer(s) from which the unit(s) (N), (F) and (R) of the polymer (P) are derived are such that said polymer (P) has a glass transition temperature Tg from about −40° C. to 150° C., preferably from about 0 to 110° C. and most particularly from about 40 to 110° C., and remains insoluble under the working conditions of the composition of the invention.

According to the invention, said polymer (P) is considered as insoluble when less than 15% and preferably less than 10% of its weight is soluble in the aqueous or wet working medium of the composition of the invention, that is to say in particular under the temperature and pH conditions of said medium.

The working pH for the composition of the invention may range from about 1 to about 12, depending on the desired use.

When it is a carpet cleaning formulation, the pH is generally between 3 and 7, preferably 4 and 6.

a detergent formulation for washing laundry or other article made of textile fibers, the pH of the washing bath is generally from about 7 to 11 and preferably from 8 to 10.5;

a rinsing and/or softening formulation, the pH of the rinsing and/or softening bath is generally from about 2 to 8;

a prespotter, the pH to be considered is that of the washing bath for the operation following the washing, namely from about 7 to 11 and preferably from 8 to 10.5;

a detergent formulation for cleaning hard surfaces, the pH of the washing bath ranges from 1 to 11.

For good implementation of the invention, at least 70% of the total mass of said polymer (P) is formed from hydrophobic unit(s) (N).

When hydrophilic units (F) are present, they preferably represent not more than 30% of the total mass of the polymer (P).

When crosslinking units (R) are present, they generally represent not more than 20%, preferably not more than 10% and most particularly not more than 5% of the total mass of the polymer (P).

A first embodiment of the invention consists of a process for enhancing the cleaning properties of a composition by adding particles of at least one uncharged or non-ionizable polymer (P1) comprising at least 70% of its weight of hydrophobic monomer units (N)

optionally at least 1% of its weight of uncharged or non-ionizable hydrophilic monomer units (F4)

optionally not more than 20% of its weight of uncharged or non-ionizable crosslinking units (R).

Preferably, according to this first embodiment, said uncharged or non-ionizable polymer (P1) comprises:

at least 70% of its weight of hydrophobic monomer units (N)

from 3% to 30% of its weight of uncharged or non-ionizable hydrophilic monomer units (F4)

optionally not more than 20% and preferably not more than 10% of its weight of uncharged or non-ionizable crosslinking units (R).

Said uncharged or non-ionizable polymer (P1) may be used in any type of carpet and rug cleaning composition mentioned above, the working pH of which may range from 2 to 12, namely detergent formulations, rinsing and/or softening formulations, drying additives, foams or prespotters.

A second embodiment of the invention consists of a process for enhancing the cleaning properties of a composition by adding particles of at least one polymer (P2) containing anionic or anionizable units and being free of cationic or cationizable units, comprising at least 70% of its weight of hydrophobic monomer units (N)

at least 1% of its weight, preferably from 3% to 30% of its weight and most particularly from 1% to 20% of its weight, of anionic or anionizable hydrophilic monomer units (F3)

optionally not more than 29% of its weight of uncharged or non-ionizable hydrophilic monomer units (F4).

Said polymer (P2) can be used in rug and carpet cleaning compositions of non-cationic nature, namely detergent formulations, foams, drying additives, or prespotters or in detergent formulations for cleaning hard surfaces.

A third embodiment of the invention consists of a process for enhancing the cleaning properties of a composition by adding particles of at least one polymer (P3) containing amphoteric units, comprising at least 70% of its weight of hydrophobic monomer units (N)

at least 0.1% of its weight, preferably not more than 20% of its weight and most particularly not more than 10% of its weight, of amphoteric hydrophilic monomer units (F2)

optionally uncharged or non-ionizable hydrophilic monomer units (F4)

optionally cationic or cationizable hydrophilic monomer units (F1), the combination of hydrophilic monomer units (F) preferably representing at least 1% of the weight of the polymer (P3), and the molar ratio of the cationic charges to the anionic charges ranging from 1/99 to 80/20 depending on the desired use of the composition (C3) obtained in this manner.

Said polymer (P3) with a molar ratio of the cationic charges to the anionic charges ranging from 1/99 to 80/20 may be used in drying additives and aqueous ironing formulations or in detergent formulations for cleaning hard surfaces.

Said polymer (P3) with a molar ratio of the cationic charges to the anionic charges ranging from 1/99 to 60/40 and preferably from 5/95 to 50/50 may also be used in detergent formulations and prespotters for rugs and carpets or in detergent formulations for cleaning hard surfaces.

A fourth embodiment of the invention consists of a process for enhancing the cleaning properties of a composition by adding particles of at least one polymer (P4) containing both cationic or cationizable units and anionic or anionizable units, comprising at least 70% of its weight of hydrophobic monomer units (N)

cationic or cationizable hydrophilic monomer units (F1)

anionic or anionizable hydrophilic monomer units (F3)

optionally amphoteric hydrophilic monomer units (F2)

optionally uncharged or non-ionizable hydrophilic monomer units (F4), the combination of hydrophilic monomer units (F) preferably representing at least 1% of the weight of the polymer (P4), and the molar ratio of the cationic charges to the anionic charges ranging from 1/99 to 80/20 depending on the desired use of the composition (C4) obtained in this manner.

Said polymer (P4) with a molar ratio of the cationic charges to the anionic charges ranging from 1/99 to 80/20 may be used in drying additives and aqueous ironing formulations.

Said polymer (P4) with a molar ratio of the cationic charges to the anionic charges ranging from 1/99 to 60/40 and preferably from 5/95 to 50/50 may also be used in detergent formulations and prespotters for rugs and carpets.

A fifth embodiment of the invention consists of a process for enhancing the cleaning properties of a composition by adding particles of at least one polymer (P5) containing cationic or cationizable units and being free of anionic or anionizable units, comprising at least 70% of its weight of hydrophobic monomer units (N)

at least 1% of its weight, preferably from 3% to 30% of its weight and most particularly from 1% to 10% of its weight of cationic or cationizable hydrophilic monomer units (F1)

optionally not more than 20% of its weight of uncharged or non-ionizable hydrophilic monomer units (F4).

Said polymer (P5) may be used in any type of fabric cleaning composition mentioned above, the working pH of which may range from 2 to 12, namely detergent formulations, rinsing and/or softening formulations, drying additives, foams or prespotters.

In a most preferred manner, when the desired composition (C5) is a detergent composition, said monomer units (F1) are cationizable units derived from at least one cationizable monomer with a pKa of less than 11 and preferably of less than 10.5.

As examples of polymer (P) in the form of particles, mention may be made in particular of the particles or aqueous dispersions of particles (latex) of the polymers or copolymers containing units derived from styrene, the glass transition temperature Tg of which is 108° C.;

methyl methacrylate/methacrylic acid, the glass transition temperature Tg of which may range from 100° C. to 130° C., depending on the composition of said copolymer;

methyl methacrylate/butyl acrylate/methacrylic acid, the glass transition temperature Tg of which may range from 60° C. to 130° C., depending on the composition of said copolymer;

methyl methacrylate/butyl acrylate/hydroxyethyl methacrylate/methacrylic acid, the glass transition temperature Tg of which may range from 10° C. to 80° C., depending on the composition of said polymer;

methyl methacrylate/ethylene glycol dimethacrylate/methacrylic acid, the glass transition temperature Tg of which may range from 10° C. to 80° C., depending on the composition of said polymer;

styrene/divinylbenzene/methacrylic acid, the glass transition temperature Tg of which may range from 100° C. to 140° C., depending on the composition of said polymer;

styrene/butyl acrylate/hydroxyethyl methacrylate/methacrylic acid, the glass transition temperature Tg of which may range from 10° C. to 80° C., depending on the composition of said polymer;

Veova 10 (vinyl $C_{10}$ versatate)/methyl methacrylate/butyl acrylate/methacrylic acid, the glass transition temperature Tg of which may range from 10° C. to 80° C., depending on the composition of said polymer;

methyl methacrylate/butyl acrylate/hydroxyethyl methacrylate/methacrylic acid/N,N-dimethyl-N-methacryloyloxyethyl-N-(3-sulfopropyl)ammonium sulfobetaine (SPE from Raschig), the glass transition temperature Tg of which may range from 10° C. to 80° C., depending on the composition of said polymer;

methyl methacrylate/butyl acrylate/hydroxyethyl methacrylate/methacrylic acid/vinylphosphonic acid, the glass transition temperature Tg of which may range from 10° C. to 80° C., depending on the composition of said polymer;

methyl methacrylate/butyl acrylate/hydroxyethyl methacrylate/methacrylic acid/Empicryl 6835 from Rhodia, the glass transition temperature Tg of which may range from 10° C. to 80° C., depending on the composition of said polymer;

styrene/styrene sulfonates, the glass transition temperature Tg of which can range from 100° C. to 130° C., depending on the composition of said polymer;

styrene/butyl acrylate/AMPS (acrylamidomethylpropanesulfonic acid), the glass transition temperature Tg of which can range from 40° C. to 130° C., depending on the composition of said polymer;

styrene/butyl acrylate/styrene sulfonates/methacrylic acid, the glass transition temperature Tg of which can range from 40° C. to 110° C., depending on the composition of said polymer.

Said polymers (P) may be introduced in solid form or, preferably, in the form of aqueous dispersions (latices) with a solids content of about 10 to 50% and preferably from 20 to 40% by weight, in the aqueous cleaning composition to be improved.

A second subject of the invention is directed toward a most preferential embodiment of the process of the invention.

The second subject of the invention thus consists of a process for increasing the cleansing properties of an aqueous cleaning composition comprising at least one surfactant, for cleaning a surface soiled with soiling, by adding to said cleaning composition at least one polymer (P) in an amount that is effective to improve the removal of the soiling from said surface, said polymer (P) being a copolymer (P')

that is insoluble under the conditions for carrying out said process and for using said composition that is in the form of particles with a mean size of from 5 to 500 nm, preferably from 5 to 100 nm and most particularly from 5 to 50 nm, as a dispersion in said aqueous composition and comprising hydrophobic polymer units (N) that are uncharged or nonionizable at the pH at which said composition is used, and at least one anionic or amphoteric, sulfur-containing, preferably sulfonated or sulfated, hydrophilic noncarboxylated monomer unit (F'), derived from α-β-monoethylenically unsaturated monomers.

Preferentially, said copolymer (P') comprises not more than 10% of its weight of carboxylated monomer units $COO^-$ and/or not more than 10% of its weight of nonamphoteric monomer units bearing a cationic charge. Said copolymer (P') is most preferentially free of carboxylated fillers and of cationic fillers (nonamphoteric).

Examples of monomers from which the hydrophobic units (N) are derived have already been mentioned above.

As examples of monomers from which the anionic or amphoteric hydrophilic noncarboxylated monomer units containing sulfur-containing functions (F'), preferably sulfonated or sulfated functions, are derived, mention may be made of:

monomers containing at least one sulfate or sulfonate function, for instance 2-sulfooxyethyl methacrylate, vinylbenzenesulfonic acid, allylsulfonic acid, 2-acrylamido-2-methylpropanesulfonic acid, sulfoethyl acrylate or methacrylate, sulfopropyl acrylate or methacrylate, and water-soluble salts thereof;

N,N-dimethyl-N-methacryloyloxyethyl-N-(3-sulfopropyl) ammonium sulfobetaine (SPE from Raschig), N,N-dimethyl-N-(2-methacrylamidoethyl)-N-(3-sulfopropyl)ammonium betaine (SPP from Raschig), 1-vinyl-3-(3-sulfopropyl)imidazolidium betaine and 1-(3-sulfopropyl)-2-vinylpyridinium betaine (SPV from Raschig).

Said copolymer (P') may also comprise units derived from other α,β-ethylenically unsaturated monomers that are noncarboxylic and noncatonic or not potentially cationic at the pH at which the composition is used.

Thus, said copolymer may optionally also comprise:

at least one noncarboxylic and noncationic crosslinking unit (R)

and/or at least one unit derived from a monomer containing at least one phosphonate or phosphate function and/or at least one uncharged or nonionizable hydrophilic unit.

Examples of monomers from which the crosslinking units (R) are derived have already been mentioned above.

Examples of monomers containing at least one phosphonate or phosphate function have already been mentioned above (in the list of monomers referred to as F3).

Examples of monomers from which the uncharged or nonionizable hydrophilic units are derived have already been mentioned above (F4).

Said copolymer (P') may also comprise units derived from carboxylated and/or nonamphoteric α,β-ethylenically unsaturated monomers that are cationic or potentially cationic at the pH at which the composition is used, and may do so in an amount corresponding to not more than 10% by weight of units derived from carboxylated α,β-ethylenically unsaturated monomers and to not more than 10% of units derived from cationic or potentially cationic, nonamphoteric α,β-ethylenically unsaturated monomers.

For good implementation of the second subject of the invention:

at least 70% of the total mass of said copolymer (P') is formed from hydrophobic unit(s) (N)

from 1% to 30% of the total mass of said copolymer (P') is formed from anionic or amphoteric unit(s) containing sulfur-containing functions (F'), preferably sulfonated or sulfated functions, when they are present, the monomer units containing phosphonate or phosphate functions represent not more than 10% of the total mass of said copolymer (P').

The total amount of hydrophilic units (i.e. the units (F'), those containing phosphonate or phosphate functions and the uncharged hydrophilic units) preferably does not represent more than 30% of the total mass of the copolymer (P).

When crosslinking units (R) are present, they generally represent not more than 20%, preferably not more than 10% and most particularly not more than 5% of the total mass of the copolymer (P').

One preferential embodiment of the second subject of the invention consists in using, in an aqueous cleaning composition, a copolymer (P") comprising at least 70% of its weight of hydrophobic monomer units (N)

at least 1% of its weight, preferably from 3 to 30% of its weight, of sulfur-containing, preferably sulfonated or sulfated, anionic monomer units (F'), and/or at least 0.1% of its weight, preferably not more than 20% of its weight and most particularly not more than 10% of its weight of hydrophilic amphoteric monomer unit (F'), that are preferably sulfonated or sulfated optionally not more than 29% of its weight of uncharged or nonionizable hydrophilic units.

Said polymer (P") may be used in any type of composition of noncationic nature for cleaning carpets and rugs, the working pH of which ranges from 2 to 12, namely detergent formulations, foams, washing additives ("prespotters") or formulations for cleaning hard surfaces (glass, ceramic, formica, etc.).

It is recalled that, preferentially, said copolymer (P") comprises not more than 10% of its weight of carboxylated monomer units $COO^-$ and/or not more than 10% of its weight of nonamphoteric monomer units bearing a cationic or potentially cationic charge.

Said copolymer (P") is most preferentially free of carboxylated charges and of cationic charges (nonamphoteric).

Examples of copolymers (P), (P') and (P") that may be mentioned include polymers or copolymers of:

methyl methacrylate/butyl acrylate/hydroxyethyl methacrylate/methacrylic acid/N,N-dimethyl-N-methacryloyloxyethyl-N-(3-sulfopropyl)ammonium sulfobetaine (SPE from Raschig), the glass transition temperature Tg of which can range from 10° C. to 80° C., depending on the composition of said copolymer;

styrene/styrene sulfonates, the glass transition temperature Tg of which can range from 100° C. to 130° C., depending on the composition of said copolymer;

styrene/butyl acrylate/AMPS (acrylamidomethylpropanesulfonic acid), the glass transition temperature Tg of which can range from 40° C. to 130° C., depending on the composition of said copolymer;

styrene/butyl acrylate/styrene sulfonate/methacrylic acid, the glass transition temperature Tg of which can range from 40° C. to 110° C., depending on the composition of said copolymer.

The amount of polymer (P) or of copolymers (P') and (P") present in the form of dispersed particles in the cleaning composition according to the invention may range from 0.05% to 50% by weight relative to the dry weight of said composition, depending on the desired application.

Thus, said polymer (P) or copolymers (P') and (P") may be used as follows:

| % of polymer (P) (as dry weight) | In a cleaning composition used |
|---|---|
| 0.01–5<br>preferably 0.05–3 | as detergent formulation for washing laundry |
| 0.05–3<br>preferably 0.1–2 | as rinsing and/or softening formulation |
| 0.05–50<br>preferably 0.1–15 | for spraying on the surface to be treated (carpet, rug before mechanical action ie. brushing, vacuum cleaning, etc.) |

-continued

| % of polymer (P) (as dry weight) | In a cleaning composition used |
|---|---|
| 0.05–10<br>preferably 0.1–5 | as prespotter |
| 0.01–5<br>preferably 0.01–0.5 | for hard surfaces |

The aqueous cleaning composition in which said polymer (P) or copolymer (P') and (P") is dispersed comprises at least one anionic, nonionic, amphoteric, zwitterionic or cationic surfactant. The rate of surfactant, expressed as dry weight, may represent from 0.1% to 50% of the weight of the composition, depending on the type of composition.

Other constituents may be present, along with the particles of polymer (P) or copolymer (P') and (P"), dispersed in the aqueous cleaning composition. The nature of these constituents depends on the desired use of said composition.

Thus, when it is a detergent formulation, for washing laundry, it generally comprises:

at least one natural and/or synthetic surfactant, at least one detergent adjuvant ("builder")

optionally an oxidizing agent or system, and a series of specific additives.

The detergent formulation may comprise surfactants in an amount corresponding to about 3% to 40% by weight relative to the detergent formulation, these surfactants being such as Anionic Surfactants alkyl ester sulfonates of formula R—CH($SO_3$M)-COOR', in which R represents a $C_8$–$C_{20}$ and preferably $C_{10}$–$C_{16}$ alkyl radical, R' represents a $C_1$–$C_6$ and preferably $C_1$–$C_3$ alkyl radical and M represents an alkali metal (sodium, potassium or lithium) cation, a substituted or unsubstituted ammonium (methyl-, dimethyl-, trimethyl- or tetramethylammonium, dimethylpiperidinium, etc.) or an alkanolamine derivative (monoethanolamine, diethanolamine, triethanolamine, etc.). Mention may be made most particularly of methyl ester sulfonates in which the radical R is $C_{14}$–$C_{16}$;

alkyl sulfates of formula R$OSO_3$M, in which R represents a $C_5$–$C_{24}$ and preferably $C_{10}$–$C_{18}$ alkyl or hydroxyalkyl radical, M representing a hydrogen atom or a cation of the same definition as above, and also the ethoxylenated (EO) and/or propoxylenated (PO) derivatives thereof, containing on average from 0.5 to 30 and preferably from 0.5 to 10 EO and/or PO units;

alkylamide sulfates of formula RCONHR'$OSO_3$M in which R represents a $C_2$–$C_{22}$ and preferably $C_6$–$C_{20}$ alkyl radical, R' represents a $C_2$–$C_3$ alkyl radical, M representing a hydrogen atom or a cation of the same definition as above, and also the ethoxylenated (EO) and/or propoxylenated (PO) derivatives thereof, containing on average from 0.5 to 60 EO and/or PO units;

saturated or unsaturated $C_8$–$C_{24}$ and preferably $C_{14}$–$C_{20}$ fatty acid salts, $C_9$–$C_{20}$ alkylbenzenesulfonates, primary or secondary $C_8$–$C_{22}$ alkylsulfonates, alkylglyceryl sulfonates, the sulfonated polycarboxylic acids described in GB-A-1 082 179, paraffin sulfonates, N-acyl N-alkyltaurates, alkyl phosphates, isethionates, alkyl succinamates, alkyl sulfosuccinates, sulfosuccinate monoesters or diesters, N-acyl sarcosinates, alkylglycoside sulfates, polyethoxycarboxylates; the cation being an alkali metal (sodium, potassium or lithium), a substituted or unsubstituted ammonium residue (methyl-, dimethyl-, trimethyl- or tetramethylammonium, dimethylpiperidinium, etc.) or an alkanolamine derivative (monoethanolamine, diethanolamine, triethanolamine, etc.);

Nonionic Surfactants polyoxyalkylenated (polyoxyethylenated, polyoxypropylenated or polyoxybutylenated) alkylphenols in which the alkyl substituent is $C_6$–$C_{12}$ and containing from 5 to 25 oxyalkylene units; examples which may be mentioned are the products Triton X-45, X-114, X-100 or X-102 sold by Rohm & Haas Co.;

glucosamide, glucamide or glycerolamide;

polyoxyalkylenated $C_8$–$C_{22}$ aliphatic alcohols containing from 1 to 25 oxyalkylene (oxyethylene or oxypropylene) units; examples which may be mentioned are the products Tergitol 15-S-9 and Tergitol 24-L-6 NMW sold by Union Carbide Corp., Neodol 45-9, Neodol 23-65, Neodol 45-7 and Neodol 45-4 sold by Shell Chemical Co., and Kyro EOB sold by The Procter & Gamble Co.;

products resulting from the condensation of ethylene oxide or the compound resulting from the condensation of propylene oxide with propylene glycol, such as the Pluronic products sold by BASF;

products resulting from the condensation of ethylene oxide or the compound resulting from the condensation of propylene oxide with ethylenediamine, such as the Tetronic products sold by BASF;

amine oxides such as $C_{10}$–$C_{18}$ alkyl dimethylamine oxides and $C_8$–$C_{22}$ alkoxy ethyl dihydroxyethylamine oxides;

the alkylpolyglycosides described in U.S. Pat. No. 4,565,647;

$C_8$–$C_{20}$ fatty acid amides;

ethoxylated fatty acids;

ethoxylated fatty amides;

ethoxylated amines.

Amphoteric and Zwitterionic Surfactants alkyldimethylbetaines, alkylamidopropyldimethylbetaines, alkyltrimethylsulfobetaines and the products of condensation of fatty acids and of protein hydrolysates;

alkyl amphoacetates or alkyl amphodiacetates in which the alkyl group contains from 6 to 20 carbon atoms.

Bleaching agent for improving the removal of oxidizable soiling:

oxidizing agents of the type: sources of peroxide such as aqueous hydrogen peroxide solution, organic peroxides, preformed peracids and mixtures of the above compounds. The potential bleaching agents are described in patent EP 0629694 B1 published on 21 Dec. 1994. The concentration of the bleaching agent may vary from 0.01% to 50%, preferably 0.1% to 20% by mass of the formulation.

The detergent adjuvants ("builders") for improving the surfactant properties may be used in amounts corresponding to about 5–50% and preferably to about 5–30% by weight for the liquid detergent formulations or to about 10–80% and preferably 15–50% by weight for the powder detergent formulations, these detergent adjuvants being such as:

Mineral Detergent Adjuvants polyphosphates (tripolyphosphates, pyrophosphates, orthophosphates or hexametaphosphates) of alkali metals, of ammonium or of alkanolamines tetraborates or borate precursors;

silicates, in particular those with an $SiO_2/Na_2O$ ratio from about 1.6/1 to 3.2/1 and the lamellar silicates described in U.S. Pat. No. 4,664,839;

alkali metal or alkaline-earth metal carbonates (bicarbonates, sesquicarbonates);

cogranulates of alkali metal silicate hydrates and of alkali metal (sodium or potassium) carbonates that are rich in silicon atoms in Q2 or Q3 form, described in EP-A-488 868;

crystalline or amorphous aluminosilicates of alkali metals (sodium or potassium) or of ammonium, such as zeolites A, P, X, etc.; zeolite A with a particle size of about 0.1–10 micrometers is preferred.

Organic Detergent Adjuvants water-soluble polyphosphonates (ethane 1-hydroxy-1,1-diphosphonates, methylenediphosphonate salts, etc.);

water-soluble salts of carboxylic polymers or copolymers or water-soluble salts thereof, such as:

polycarboxylate ethers (oxydisuccinic acid and salts thereof, monosuccinic acid tartrate and salts thereof, disuccinic acid tartrate and salts thereof);

hydroxypolycarboxylate ethers;

citric acid and salts thereof, mellitic acid and succinic acid and salts thereof;

polyacetic acid salts (ethylenediaminetetraacetates, nitrilotriacetates, N-(2-hydroxyethyl)nitrilodiacetates);

$C_5$–$C_{20}$ alkyl succinic acids and salts thereof (2-dodecenylsuccinates, lauryl succinates);

carboxylic polyacetal esters;

polyaspartic acid and polyglutamic acid and salts thereof;

polyimides derived from the polycondensation of aspartic acid and/or of glutamic acid;

polycarboxymethyl derivatives of glutamic acid or of other amino acids.

The detergent formulation may also comprise at least one oxygen-releasing bleaching agent comprising a percompound, preferably a persalt. Said bleaching agent may be present in an amount corresponding to about 1% to 30% and preferably from 4% to 20% by weight relative to the detergent formulation.

As examples of percompounds which may be used as bleaching agents, mention should be made in particular of perborates such as sodium perborate monohydrate or tetrahydrate; peroxygenated compounds such as sodium carbonate peroxyhydrate, pyrophosphate peroxyhydrate, urea peroxyhydrate, sodium peroxide and sodium persulfate.

The preferred bleaching agents are sodium perborate monohydrate or tetrahydrate and/or sodium carbonate peroxyhydrate.

Said agents are generally combined with a bleaching activator which generates, in situ in the washing medium, a peroxycarboxylic acid in an amount corresponding to about 0.1% to 12% and preferably from 0.5% to 8% by weight relative to the detergent formulation. Among these activators, mention may be made of tetraacetylethylenediamine, tetraacetylmethylenediamine, tetraacetylglycoluryl, sodium p-acetoxybenzenesulfonate, pentaacetylglucose and octaacetyllactose.

Mention may also be made of non-oxygenated bleaching agents, which act by photo-activation in the presence of oxygen, these being agents such as sulfonated aluminum and/or zinc phthalocyanins.

The detergent formulation may also comprise soil-release agents, anti-redeposition agents, chelating agents, dispersants, fluorescers, foam suppressants, softeners, enzymes and various other additives.

Soil-Release Agents

These may be used in amounts of about 0.01–10%, preferably about 0.1–5% and more preferably about 0.2–3% by weight.

Mention may be made more particularly of agents such as:

cellulose derivatives such as cellulose hydroxy ethers, methylcellulose, ethylcellulose, hydroxypropylmethylcellulose or hydroxybutylmethylcellulose;

polyvinyl esters grafted onto polyalkylene trunks, such as polyvinyl acetates grafted onto polyoxyethylene trunks (EP-A-219 048);

polyvinyl alcohols;

polyester copolymers based on ethylene terephthalate and/or propylene terephthalate and polyoxyethylene terephthalate units, with an ethylene terephthalate and/or propylene terephthalate (number of units)/polyoxyethylene terephthalate (number of units) molar ratio from about 1/10 to 10/1 and preferably from about 1/1 to 9/1, the polyoxyethylene terephthalates containing polyoxyethylene units with a molecular weight from about 300 to 5 000 and preferably from about 600 to 5 000 (U.S. Pat. No. 3,959,230, U.S. Pat. No. 3,893,929, U.S. Pat. No. 4,116,896, U.S. Pat. No. 4,702,857, U.S. Pat. No. 4,770,666);

sulfonated polyester oligomers obtained by sulfonation of an oligomer derived from ethoxylated allylic alcohol, from dimethyl terephthalate and from 1,2-propylene diol, containing from 1 to 4 sulfonated groups (U.S. Pat. No. 4,968,451);

polyester copolymers based on propylene terephthalate and polyoxyethylene terephthalate units and ending with ethyl or methyl units (U.S. Pat. No. 4,711,730) or polyester oligomers ending with alkylpolyethoxy groups (U.S. Pat. No. 4,702,857) or sulfopolyethoxy (U.S. Pat. No. 4,721,580) or sulfoaroyl (U.S. Pat. No. 4,877,896) anionic groups;

sulfonated polyester copolymers derived from terephthalic, isophthalic and sulfoisophthalic acid, anhydride or diester and from a diol (FR-A-2 720 399).

Anti-Redeposition Agents

These may be used in amounts generally of about 0.01–10% by weight for a powder detergent formulation or of about 0.01-5% by weight for a liquid detergent formulation.

Mention may be made in particular of agents such as:

ethoxylated monoamines or polyamines, and ethoxylated amine polymers (U.S. Pat. No. 4,597,898, EP-A-11 984);

carboxymethylcellulose;

sulfonated polyester oligomers obtained by condensation of isophthalic acid, dimethyl sulfosuccinate and diethylene glycol (FR-A-2 236 926);

polyvinylpyrrolidones.

Chelating Agents

Agents for chelating iron and magnesium may be present in amounts of about 0.1–10% and preferably of about 0.1–3% by weight.

Mention may be made, inter alia, of:

aminocarboxylates such as ethylenediaminetetraacetates, hydroxyethylethylenediaminetriacetates and nitrilotriacetates;

aminophosphonates such as nitrilotris(methylenephosphonates);

polyfunctional aromatic compounds such as dihydroxydisulfobenzenes.

Polymeric Dispersants

These may be present in an amount of about 0.1–7% by weight, to control the calcium and magnesium hardness, these being agents such as:

water-soluble polycarboxylic acid salts with a molecular mass from about 2 000 to 100 000, obtained by polymerization or copolymerization of ethylenically unsaturated carboxylic acids such as acrylic acid, maleic acid or anhydride, fumaric acid, itaconic acid, aconitic acid, mesaconic acid, citraconic acid or methylenemalonic acid, and most particularly polyacrylates with a molecular mass from about 2 000 to 10 000 (U.S. Pat. No. 3,308,067), copolymers of arylic acid and of maleic anhydride with a molecular mass from about 5 000 to 75 000 (EP-A-66 915);

polyethylene glycols with a molecular mass from about 1 000 to 50 000.

Fluorescers (Brighteners)

These may be present in an amount of about 0.05–1.2% by weight, these being agents such as: stilbene, pyrazoline, coumarin, fumaric acid, cinnamic acid, azole, methinecyanin, thiophene, etc. derivatives ("The production and application of fluorescent brightening agents"—M. Zahradnik, published by John Wiley & Sons, New York, 1982).

Foam Suppressants

These may be present in amounts which may be up to 5% by weight, these being agents such as:

$C_{10}$–$C_{24}$ monocarboxylic fatty acids or alkali metal, ammonium or alkanolamine salts thereof, and fatty acid triglycerides;

saturated or unsaturated aliphatic, alicyclic, aromatic or heterocyclic hydrocarbons, such as paraffins and waxes;

N-alkylaminotriazines;

monostearyl phosphates and monostearyl alkyl phosphates;

polyorganosiloxane oils or resins optionally combined with silica particles.

Softeners

These may be present in amounts of about 0.5–10% by weight, these being agents such as clays.

Enzymes

These may be present in an amount which may be up to 5 mg by weight and preferably of about 0.05–3 mg of active enzyme/g of detergent formulation, these being enzymes such as:

proteases, amylases, lipases, cellulases and peroxidases (U.S. Pat. No. 3,553,139, U.S. Pat. No. 4,101,457, U.S. Pat. No. 4,507,219, U.S. Pat. No. 4,261,868).

Other Additives

Mention may be made, inter alia, of:

buffers, fragrances, pigments.

The detergent formulation may be used with all methods, in particular spraying, washing, coating, impregnation, soaking and milling, in a proportion of from 0.1 g/l to 400 g/l and preferably from 1 g/l to 50 g/l to carry out washing operations at a temperature from about 25 to 90° C.

The cleaning composition may be an aqueous liquid rinsing formulation capable of facilitating the subsequent cleaning.

This formulation may be used in a proportion of 0.2 to 10 g/l and preferably from 2 to 10 g/l.

Along with the [lacuna] of the polymer (P) or the copolymer (P') and (P"), there may be present other constituents of the type such as:

combinations of cationic surfactants (triethanolamine diester quaternized with dimethyl sulfate, N-methylimidazoline tallow ester methyl sulfate, dialkyldimethylammonium chloride, alkylbenzyldimethylammonium chloride, alkylimidazolinium methyl sulfate, methylbis(alkylamidoethyl)-2-(hydroxyethylammonium) methyl sulfate, etc., in an amount which may range from 3% to 50% and preferably from 4% to 30% of said formulation, optionally combined with nonionic surfactants (ethoxylated fatty alcohols, ethoxylated alkylphenols, etc.) in an amount which may be up to 3%;

oxidizing agents of the type such as: sources of peroxides, such as aqueous hydrogen peroxide solution, organic peroxides, preformed peracids and mixtures of the above compounds. The potential bleaching agents are described in patent EP 0629694 B1 published on 21 Dec. 1994. The concentration of the bleaching agent may range from 0.01% to 50% and preferably from 0.1% to 20% by mass of the formulation.—optical brighteners (0.1% to 0.2%);

optionally, color-fast agents (polyvinylpyrrolidone, polyvinyloxazolidone, polymethacrylamide, etc., 0.03% to 25% and preferably 0.1% to 15%);

colorants;

fragrances;

solvents, in particular alcohols (methanol, ethanol, propanol, isopropanol, ethylene glycol or glycerol);

foam limiters.

When the aqueous cleaning composition is a washing additive ("prespotter") said composition may be in the form of an aqueous dispersion, a solid (tube) or a foam.

Along with the polymer (P) or the copolymer (P') and (P"), there may be present other constituents of the type such as:

anionic surfactants such as those already mentioned above, in an amount of at least 5% relative to the weight of the composition;

nonionic surfactants such as those already mentioned above, in an amount which may range from 15% to 40% relative to the weight of the composition;

aliphatic hydrocarbons, in an amount which may range from 5% to 20% relative to the weight of the composition;

oxidizing agents of the type such as: sources of peroxides, such as aqueous hydrogen peroxide solution, organic peroxides, preformed peracids and mixtures of the above compounds. The potential bleaching agents are described in patent EP 0629694 B1 published on 21 Dec. 1994. The concentration of the bleaching agent may range from 0.01% to 50% and preferably from 0.1% to 20% by mass of the formulation.

When the aqueous cleaning composition is a composition for cleaning hard surfaces, it may comprise, along with said poly (P) or copolymer (P') or (P"), common soluble or dispersible additives that can promote its stability, its wettability, give a biocidal nature or give other additional properties.

Examples of additives that may be mentioned include:

surfactants (from 0.1% to 50% as solids of the weight of the aqueous composition), especially nonionic surfactants of the type such as polyoxyethylenated $C_6$–$C_{12}$ alkylphenols, polyoxyethylenated and/or polyoxyproylenated $C_8$–$C_{22}$ aliphatic alcohols, ethylene oxide/propylene oxide block copolymers, and optionally polyoxyethylenated carboxylic amides, anionic or amphoteric surfactants, for instance those of the type such as alkali metal soaps (alkaline salts of $C_8$–$C_{24}$ fatty acids), alkaline sulfonates ($C_8$–$C_{13}$ alkylbenzene sulfonates or $C_{12}$–$C_{16}$ alkylsulfonates), oxyethylenated and sulfated $C_6$–$C_{16}$ fatty aclohols, oxyethylenated and sulfated $C_8$–$C_{13}$ alkylphenols, alkaline sulfosuccinates ($C_{12}$–$C_{16}$ alkylsulfosuccinates), betaines, etc., catonic surfactants of $C_8$–$C_{24}$ fatty acids, which are optionally benzylated, biocides or bacteriostatic agents capable of giving the dispersions a biocidal nature, for instance cationic surfactants (alkyldimethylammonium halides, etc.), phosphonium or quaternary ammonium halide biocides, amphoteric biocides derived from glycines, phenolic biocides, biocides derived from chlorhexidine, hypochlorites, polyquaternary ammonium film-forming biocides or polymers, etc., chelating agents, for instance aminocarboxylates, film-forming antisoiling agents, for instance optionally sulfonated terephthalic polyesters, etc., alcohols (ethanol, isopropanol or glycols), detergent adjuvants (phosphates, silicates), fragrances, colorants, etc.

These various additives other than the polymer (P) or copolymer (P') and (P") and the surfacatant(s) may be present in a proportion of from 0 to 15% by weight of said aqueous cleaning composition.

The cleaning operation consists in applying said cleaning composition, optionally diluted from 1- to 1000-fold, preferably from 1- to 100-fold, to the hard surface to be cleaned.

The dispersion may be applied to the soiled surface, for example, by dipping, fine spraying, coating by application using a sponge, a floor cloth or using a preimpregnated cellulose-based material.

The amount of cleaning composition that may be favorably used is that corresponding to a deposition of from 0.0001 to 1 g and preferably from 0.0005 to 0.1 g of copolymer (P) per $m^2$ of hard surface to be treated.

The particles are formed from polymer chains. The most hydrophilic chains are preferably located at the surface of the particle, thus forming the shell. The most hydrophobic chains are located inside the particle, thus forming the core of the particle.

The advantages of the process using the polymers (P) or copolymer (P') and (P") are especially as follows:

after applying [lacuna] or copolymer (P') and (P") as a dispersion, to the surface to be cleaned, the liquid continuous phase, typically water, evaporates naturally or by heating or by penetrating into the support and forms a stack/aggregate of particles or a continuous film or both simultaneously on contact with the soiling to be removed. The "soiling-polymer" composite thus formed is then removed by any means known to those skilled in the art (flushing, suction, brushing, combing, rinsing, peeling, etc.);

the shell of the particle of polymer (P) or copolymer (P') and (P") is chosen depending on the physicochemical nature of the support to be treated, so as to minimize the interaction between the aggregate/polymer film and the surface to be treated after removing the continuous phase. The problem solved by the invention is, specifically, that of avoiding the adhesion of the particle of soiling encapsulated by the polymer (P) or copolymer (P') and (P") at the surface of the support by an astute choice of the nature and content of the monomers constituting the latex.

The process according to the invention is particularly advantageous for improving the cleaning properties of compositions for cleaning nylon carpets; the polymers (P) that are preferentially used are those whose particles have at the surface sulfonate and/or sulfate units (copolymers P' and P") and whose overall composition is such that the Tg at the working pH of the cleaning composition is between 60 and 110° C. Preferably, the particle size is then between 5 and 50 nm.

The diameters of the polymer (P) particles may be determined in a well-known manner by light scattering or by transmission electron microscopy.

A third object of the invention consists in using, in an aqueous cleaning composition comprising at least one surfactant for cleaning a surface soiled with soiling, a polymer (P) or a copolymer (P') or (P") as described above, as an agent for improving the removal of the soiling from said surface.

The soiling that may thus be removed is especially fatty soiling (for example oils), mineral soiling (carbon black or insoluble metal salts), protein-based soiling (coffee, milk or fruit juice stains) that are in most cases oxidizable or decomposable by the presence of enzymes, and natural soiling of cellulosic type.

The examples which follow are given for illustrative purposes, without any limitation whatsoever being implied.

EXAMPLE 1

The detergent formulation used is adjusted to pH 4. The polymers and copolymers tested were used in the form of an aqueous dispersion (latex); they were obtained by emulsion polymerization and have the following characteristics:

Latex L 1*a*: Styrene, 100%, Tg of 108° C. at pH 4, particle size 40 nm.

Latex L 1*b*: Styrene/styrene sulfonate, 95/5, Tg of 104° C. at pH 4, particle size of 21 nm Latex L 1*c*: Styrene/AMPS, 95/5, Tg of 108° C. at pH 4, particle size of 43 nm Latex L 1*d*: Styrene/BuA/AMPS 72/23/5, Tg of 65° C. at pH 4, particle size of 48 nm Latex L 1*e*: Styrene/MMA/styrene sulfoante 71/24/5 Tg of 110° C., particle size of 13 nm Latex L 2*a*: MMM/MAA 95/5 Tg of 115° C. at pH 4, particle size of 88 nm Latex L 2*b*: MMA/BuA/MAA 95/0/5 Tg of 129° C. at pH 4, particle size of 32 nm Latex L 2*c*: MMA/BuA/MAA 83/12/5 Tg of 83° C., particle size of 26 nm Latex L 2*d*: MMA/BuA/MAA 70/25/5 Tg of 54° C., particle size of 26 nm The abbreviations above have the following meanings:

MMA methyl methacrylate

MAA methacrylic acid

The size of the latex particles was determined by light scattering using a Zetasizer machine from Malvern Instruments.

| FORMULATION Constituents % by weight | I | II | 1a | 1b | 1c | 1d | 1e | 2a | 2b | 2c | 2d |
|---|---|---|---|---|---|---|---|---|---|---|---|
| Latex tested | | | L 1a | L 1b | L 1c | L 1d | L 1e | L 2a | L 2b | L 2c | L 2d |
| | 0 | 0 | 4 | 4 | 4 | 4 | 4 | 4 | 4 | 4 | 4 |
| H2O2 | 0 | 2 | 2 | 2 | 2 | 2 | 2 | 2 | 2 | 2 | 2 |
| Alkyl sulfate anionic surfactant (SDS) | 0 | 0.3 | 0.3 | 0.3 | 0.3 | 0.3 | 0.3 | 0.3 | 0.3 | 0.3 | 0.3 |
| H2O | 0 | 97.6 | 93.6 | 93.6 | 93.6 | 93.6 | 93.6 | 93.6 | 93.6 | 93.6 | 93.6 |
| Fragrances | 0 | 0.1 | 0.1 | 0.1 | 0.1 | 0.1 | 0.1 | 0.1 | 0.1 | 0.1 | 0.1 |

In order to compare the performance qualities of the cleaning formulations, the following comparative test is performed.

A polyamide carpet is cleaned using a sprayer by spraying the carpet with the aqueous base composition given in the above table. Typically, from 15 to 25 ml of formulation/$m^2$ of surface to be treated is used. In this specific example, the carpet is presoiled according to the protocol of ISO/DIS standard 11378, which is well known to those skilled in the art, with a model soiling such as the soiling B5 described in Annex B of iso DIS standard 11378 (reference "AATCC soil") which is dispersed uniformly over the carpet. 15 ml of formulation (A)/$m^2$ are then sprayed on. The carpet is left to dry for at least half an hour at ambient temperature. Finally, the carpet thus treated is vacuumed using a conventional household vacuum cleaner of Hoover type. Optionally, the carpet may be brushed beforehand. In this particular example, the carpet is vacuumed without brushing, but the vacuum cleaner has a built-in brush system.

After each application followed by vacuuming, the visual appearance of the carpet is noted, and a touch test is carried out. Any possible comments are given in the table below. The change in the color of the carpet is measured by image analysis ($\Delta L$ is the change in whiteness=$L_{after}-L_{before}$: the smaller and more positive the value of $\Delta L$, the smaller the color difference before and after washing. The more positive the value of $\Delta L$, the more the carpet whitens, and the more negative the value of $\Delta L$, the more the carpet darkens. The powder which has been vacuumed up is analyzed by electron microscopy. The removal of the soiling is also measured by a surface analysis technique: only the difference with control (simple vacuuming) is noted in the table.

The results are given in the table below after 10 cycles (ie. 10 sprayings, 10 dryings and 10 vacuum cleanings).

| Formulation | I | II | 1a | 1b | 1c | 1d | 1e | 2a | 2b | 2c | 2d |
|---|---|---|---|---|---|---|---|---|---|---|---|
| ΔL | 0 | −5 | 5 | 2 | 1 | 0 | 0 | 2 | 4 | 3 | 0 |
| Feel* | + | + | −−− | − | + | + | + | − | −− | −− | −−−− |
| Powder removed** | 0 | 0 | very little | + | + | + | + | + | little | + | 0 |

-continued

| Formulation | I | II | 1a | 1b | 1c | 1d | 1e | 2a | 2b | 2c | 2d |
|---|---|---|---|---|---|---|---|---|---|---|---|
| Soiling/ vacuum cleaner*** | + | − | + | + | + | ++ | +++ | ++ | − | + | −− |

The above symbols denote:
Feel*
+ good
−−− very coarse
− not particularly coarse
−− coarse
−−−− very plastic
Powder removed**
0 none
+ aggregated particles
Soiling/vacuum cleaner***
+ reference or equal to the reference
− worse than the reference
−− even worse
++ better than the reference
+++ even better The conclusions from these experiments are as follows:

A water-based formulation (II) darkens the carpet and does not help to remove the soiling.

If the carpet becomes coarse, this is because a large proportion of the latex has not been removed. This measurement is generally closely correlated with the whitening of the carpet ($\Delta L>2$). Latices with a low Tg (2*d*) give poorer results since they plasticize the carpet and do not correctly remove the soiling.

Carboxylated latices (which comprise surface acrylates) remove the soiling correctly but are difficult to remove from the carpet, unless their size is optimized (2*a* versus 2*b* and 2*c*). Polystyrene-based latices give advantageous results, but on adding surface sulfonated units, their performance qualities are considerably increased (comparison 1*a* and 1*b*/1*c*/1*d*/1*e*). Sulfonate latices of the type 1*b*, 1*c*, 1*d* and 1*e* are excellent candidates since they do not accumulate (or accumulate only little) on the carpet and they do not modify the surface appearance or the feel. By optimizing their glass transition temperature (Tg), good efficacy is obtained (comparison of 1*b*, 1*c* and 1*d*). Nanolatices 1*c* and 1*d* thus give good results. The result is optimum with the hardest and smallest latex, that is to say, with the latex 1*e*.

EXAMPLE 2

Formulation of Prespotter Type

The aim of this experiment is to show that the amount of polymer particles deposited on the surface to be cleaned governs the size of the final chips and thus the ability to coat or imprison soiling. For this, use is made of synthetic nanolatices (solids content of 30% on average), which are coated onto polyamide surfaces presoiled with coffee; the coating is carried out using a threaded rod of different thicknesses.

After drying by evaporation in an air-conditioned room (20° C. and 50% RH), the size of the chips obtained is measured (by image acquisition, processing and analysis; 1 mm=17 pixel). The edges of the samples dry faster than the center due to an end effect. Typically, relatively heterogeneous chips are obtained.

Carboxylated Latex

A series of increasing coat thickness is produced on the nanolatex 2*c*. FIG. 1/2 shows the results. It is seen that the size of the chips increases overall as the coat thickness increases. It is deduced therefrom that the greater the amount sprayed (or the larger the droplet size), the larger the latex aggregates. After vacuum cleaning, the intensity of the residual coffee stain is measured by eye and it is very clearly seen that the stain is proportionately more easily removed the larger the chips formed.

Figure 2:
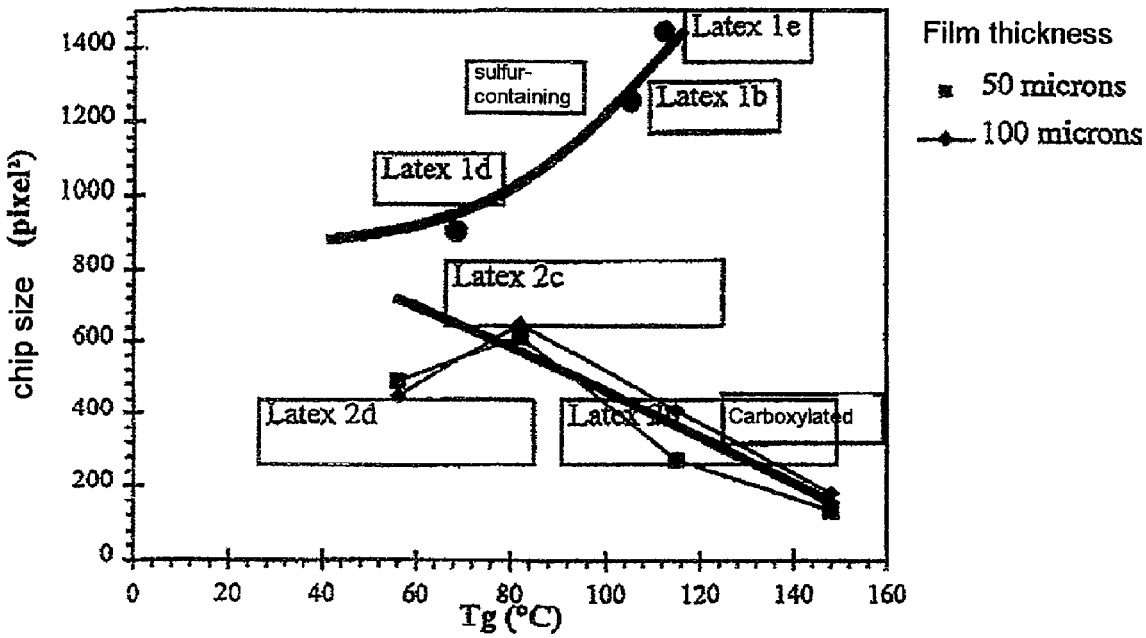

Different latices are used: latices 2*b*, 2*c* and 2*d* have virtually the same size and a variable Tg. According to FIG. 2/2, it is clearly seen that the lower the Tg, the larger the chips; in the extreme case, chips are no longer formed with latex 2*d*, which forms an adhesive film. The effect on the coffee stain is as follows: in the case of latex 2*d*, the stain was not removed, it is brighter. In the case of latex 2*c*, the removal is satisfactory, which is not the case for latex 2*b*, and the removal is substantially improved with latex 2*a*. It is concluded therefrom that there is a maximum glass transition temperature Tg above which the latex has no effect on the stain. This temperature is, according to the above experiment, reasonably located between 54 and 82° C.

Thus, with latices of acrylate type, the best cleaning agents have a Tg of about 60° C. and a size close to 100 nm.

Sulfur-Containing Latices

Different latices are used: latices L 1*b*, L 1*d* and L 1*e* have virtually the same size and a variable Tg. According to FIG. 2/2, it is clearly seen that the lower the Tg, the smaller the chips; interestingly, even low Tgs form larger chips than their carboxylated homologs. The effect on the coffee stain is as follows: in all cases, the coffee stain is markedly removed. However, the increase in the Tg of the latex (from 1*d*, then 1*b*, then 1*e* leads to an improvement in the removal. It is concluded therefrom that the higher the Tg of the sulfur-containing latex, the better its anti-stain activity. The latex preferably has a Tg which is greater than 100° C.

What is claimed is:

1. A process for enhancing the cleaning properties of an aqueous cleaning composition which comprises at least one surfactant, said process comprising adding to said cleaning composition particles of at least one polymer (P) comprising:

(a) hydrophobic monomer units (N) that are uncharged or nonionizable at the working pH of said composition:

(b) at least one hydrophilic monomer unit (F) that is a (F3) monomer that is anionic or potentially anionic at the working pH of said composition;

(c) at least one further hydrophilic monomer unit (F) that is a cationic or cationizable hydrophilic unit (F1) derived from N,N-(dialkylamino-ω-alkyl)amides of α-β monoethylenically unsaturated carboxylic acids, from α-β monoethylenically unsaturated amino esters or from monomers that are precursors of primary amine functions by hydrolysis;

(d) optionally, at least a second further hydrophilic monomer unit (F) selected from the group consisting of the following monomer units;

(i) (F1) monomers that are cationic or potentially cationic at the working pH of said composition;

(ii) (F2) monomers that are amphoteric at the working pH of said composition; and (iii) (F4) monomers that are uncharged or nonionizable, of hydrophilic nature, at the working pH of said composition;

(e) optionally, at least one crosslinking unit (R); said cleaning composition being a hard surface cleaning detergent formulation, the particles of said polymer (P) having an average size of from 5 to 300 nm.

2. A process according to claim 1, wherein said agueous cleaning composition is a detergent formulation for cleaning hard surfaces comprising from 0.01% to 5% by weight of said polymer (P), expressed as solids.

3. A process according to claim 1, wherein said monomer units (N) and (F) are derived from α-β monoethylenically unsaturated monomers, and the optional monomer units (R) are derived from diethylenically unsaturated monomers.

4. A process according to claim 1, wherein the hydrophobic units (N) are derived from vinylaromatic monomers, from α-β monoethylenically unsaturated acid alkyl esters, from vinyl or allyl esters of saturated carboxylic acids or from α-β monoethylenically unsaturated nitriles.

5. A process according to claim 1, wherein the hydrophobic units (N) are derived from vinylaromatic monomers, from α-β monoethylenically unsaturated acid alkyl esters, from vinyl or allyl esters of saturated carboxylic acids or from α-β monoethylenically unsaturated nitriles; and wherein said aqueous cleaning composition is a detergent formulation for cleaning hard surfaces comprising from 0.01% to 5% by weight of said polymer (P), expressed as solids.

6. A process according to claim 1, wherein the monomer units (N) and (F) are derived from α-β monoethylenically unsaturated monomers, and the optional monomer units (R) are derived from diethylenically unsaturated monomers, and wherein the hydrophobic units (N) are derived from vinylaromatic monomers, from α-β monoethylenically unsaturated acid alkyl esters, from vinyl or allyl esters of saturated carboxylic acids or from α-β monoethylenically unsaturated nitriles.

7. A process for enhancing the cleaning properties of an aqueous cleaning composition which comprises at least one surfactant, said process comprising adding to said cleaning composition particles of at least one polymer (P) comprising:

(a) hydrophobic monomer units (N) that are uncharged or nonionizable at the working pH of said composition;

(b) at least one hydrophilic monomer unit (F) that is a (F3) monomer that is anionic or potentially anionic at the working pH of said composition;

(c) at least one further monomer unit (F) that is an amphoteric hydrophilic unit (F2) derived from N,N-dimethyl-N-methacryloyloxyethyl-N-(3-sulfopropyl) ammonium sulfobetaine, N,N-dimethyl-N-(2-methacrylamidoethyl)-N-(3-sulfopropyl )ammonium betaine, 1-vinyl-3-(3-sulfopropyl)imidazolidium betaine, or 1-(3-sulfopropyl)-2-vinylpyridinium betaine, or derived from the quaternization reaction of an N-(dialkylamino-ω-alkyl)amide of an α-β ethylenically unsaturated carboxylic acid or of an α-β monoethylenically unsaturated amino ester with an alkali metal chloroacetate or a propane sultone chloroacetate;

(d) optionally, at least a second further hydrophilic monomer unit (F) selected from the group consisting of the following monomer units:

(i) (F1) monomers that are cationic or potentially cationic at the working pH of said composition;

(ii) (F2) monomers that are amphoteric at the working pH of said composition; and (iii) (F4) monomers that are uncharged or nonionizable, of hydrophilic nature, at the working pH of said composition;

(e) optionally, at least one crosslinking unit (R); said cleaning composition being a hard surface cleaning detergent formulation, the particles of said polymer (P) having an average size of from 5 to 300 nm.

8. A process according to claim 7, wherein said aqueous cleaning composition is a deteraent formulation for cleaning hard surfaces comprising from 0.01% to 5% by weight of said polymer (P), expressed as solids.

9. A process according to claim 7, wherein said monomer units (N) and (F) are derived from α-β monoethylenically unsaturated monomers, and the optional monomer units (R) are derived from diethylenically unsaturated monomers.

10. A process according to claim 7, wherein the hydrophobic units (N) are derived from vinylaromatic monomers, from α-β monoethylenically unsaturated acid alkyl esters, from vinyl or allyl esters of saturated carboxylic acids or from α-β monoethylenically unsaturated nitriles.

11. A process according to claim 1, wherein a second further monomer unit (F) is present and comprises at least one amphoteric hydrophilic unit (F2) derived from N,N-dimethyl-N-methacryloyloxyethyl-N-(3-sulfopropyl)ammonium sulfobetaine, N,N-dimethyl-N-(2-methacrylamidoethyl)-N-(3-sulfopropyl)ammonium betaine, 1-vinyl-3-(3-sulfopropyl)imidazolidium betaine, or 1-(3-sulfopropyl)-2-vinylpyridinium betaine, or derived from the quaternization reaction of an N-(dialkylamino-ω-alkyl)amide of an α-β ethylenically unsaturated carboxylic acid or of an α-β monoethylenically unsaturated amino ester with an alkali metal chloroacetate or a propane sultone chloroacetate.

12. A process according to claim 2, wherein a second further monomer unit (F) is present and comprises at least one amphoteric hydrophilic unit (F2) derived from N,N-dimethyl-N-methacryloyloxyethyl-N-(3-sulfopropyl)ammonium sulfobetaine, N,N-dimethyl-N-(2-methacrylamidoethyl)-N-(3-sulfopropyl)ammonium betaine, 1-vinyl-3-(3-sulfopropyl)imidazolidium betaine, or 1-(3-sulfopropyl)-2-vinylpyridinium betaine, or derived from the quaternization reaction of an N-(dialkylamino-ω-alkyl)amide of an α-β ethylenically unsaturated carboxylic acid or of an α-β monoethylenically unsaturated amino ester with an alkali metal chloroacetate or a propane sultone chloroacetate.

13. A process for enhancing the cleaning properties of an aqueous cleaning composition which comprises at least one surfactant, said process comprising adding to said cleaning composition particles of at least one polymer (P) comprising:

(a) hydrophobic monomer units (N) that are uncharged or nonionizable at the working pH of said composition;

(b) at least one hydrophilic monomer unit (F) that is a (F3) monomer that is anionic or potentially anionic at the working pH of said composition;

(c) at least one further hydrophilic monomer unit (F) that is an uncharged or nonionizable hydrophilic unit (F4) derived from hydroxyalkyl esters of α-β monoethylenically unsaturated acids, from amides of α-β monoethylenically unsaturated acids, from α-β ethylenically unsaturated monomers containing a water-soluble polyoxyalkylenated segment, from α-β monoethylenically unsaturated monomers that are precursors of vinyl alcohol units or polyvinyl alcohol segments by polymerization and then hydrolysis, or from methacrylamidoethyl 2-imidazolidinone;

(d) optionally, at least a second further hydrophilic monomer unit (F) selected from the group consisting of the following monomer units:

(i) (F1) monomers that are cationic or potentially cationic at the working pH of said composition;

(ii) (F2) monomers that are amphoteric at the working pH of said composition; and (iii) (F4) monomers that are uncharged or nonionizable, of hydrophilic nature, at the working pH of said composition;

(e) optionally, at least one crosslinking unit (R); said cleaning composition being a hard surface cleaning detergent formulation, the particles of said polymer (P) having an average size of from 5 to 300 nm.

14. A process according to claim 13, wherein said agueous cleaning composition is a detergent formulation for cleaning hard surfaces comprising from 0.01% to 5% by weight of said polymer (P), expressed as solids.

15. A process according to claim 1, wherein the average size of the polymer (P) particles ranges from 5 nm to 100 nm.

16. A process according to claim 15, wherein the average size of the polymer (P) particles ranges from 10 nm to 50 nm.

17. A process according to claim 1, wherein said polymer (P) has a glass transition temperature Tg of from −40° C. to 150° C., and remains insoluble under the working conditions of said composition.

18. A process according to claim 17, wherein the glass transition temperature Tg of said polymer is from 0° to 110° C.

19. A process according to claim 18, wherein the glass transition temperature Tg of said polymer is from 40° C. to 110° C.

20. A process according to claim 15, wherein said polymer (P) has a glass transition temperature Tg of from −40° C. to 150° C., and remains insoluble under the working conditions of said composition.

21. A process according to claim 20, wherein the glass transition temperature Tg of said polymer is from 0° to 110° C.

22. A process according to claim 21, wherein the glass transition temperature Tg of said polymer is from 40° C. to 110° C.

23. A process according to claim 16, wherein said polymer (P) has a glass transition temperature Tg of from −40° C. to 150° C., and remains insoluble under the working conditions of said composition.

24. A process according to claim 23, wherein the glass transition temperature Tg of said polymer is from 0° C. to 110° C.

25. A process according to claim 24, wherein the glass transition temperature Tg of said polymer is from 40° C. to 110° C.

26. A process according to claim 1, wherein polymer (P) is present in the form of an aqueous dispersion having a solids content of from 10% to 50% by weight.

27. A process according to claim 26, wherein said solids content is from 20% to 40% by weight.

28. A process according to claim 1, wherein said polymer (P) is present in a proportion of from 0.05% to 50% in solid form of the weight of said cleaning composition.

29. A process according to claim 2, wherein said detergent formulation for cleaning hard surfaces comprises from 0.01% to 0.5% by weight of said polymer (P), expressed as solids.

30. A process according to claim 1, wherein at least one crosslinking unit (R) is present and is derived from divinylbenzene, from ethylene glycol dimethacrylate, from allyl methacrylate, from methylenebis(acrylamide) or from glyoxalbis(acrylamide).

31. A process according to claim 2, wherein at least one crosslinking unit (R) is present and is derived from divinylbenzene, from ethylene glycol dimethacrylate, from allyl methacrylate, from methylenebis(acrylamide) or from glyoxalbis(acrylamide).

32. A process according to claim 1, wherein at least 70% of the total mass of said polymer (P) is formed from hydrophobic unit(s) (N) and wherein the hydrophilic units (F) represent not more than 30% of the total mass of the polymer (P) and the crosslinking units (R) represent not more than 20% of the total mass of the polymer (P).

33. A process according to claim 32, wherein the crosslinking units (R) represent not more than 10% of the total mass of the polymer (P).

34. A process according to claim 33, wherein the crosslinking units (R) represent not more than 5% of the total mass of the polymer(P).

35. A process according to claim 7, wherein the average size of the polymer (P) particles ranges from 5 nm to 100 nm.

36. A process according to claim 35, wherein the average size of the polymer (P) particles ranges from 10 nm to 50 nm.

37. A process according to claim 7, wherein said poiymer (P) has a glass transition temperature Tg of from −40° C. to 150° C., and remains insoluble under the working conditions of said composition.

38. A process according to claim 37, wherein the glass transition temperature Tg of said polymer is from 0° C. to 110° C.

39. A process according to claim 38, wherein the glass transition temperature Tg of said polymer is from 40° C. to 110° C.

40. A process according to claim 35, wherein said polymer (P) has a glass transition temperature Tg of from −40° C. to 150° C., and remains insoluble under the working conditions of said composition.

41. A process according to claim 40, wherein the glass transition temperature Tg of said polymer is from 0° C. to 110° C.

42. A process according to claim 41, wherein the glass transition temperature Tg of said polymer is from 40° C. to 110° C.

43. A process according to claim 36, wherein said polymer (P) has a glass transition temperature Tg of from −40° C. to 150° C., and remains insoluble under the working conditions of said composition.

44. A process according to claim 43, wherein the glass transition temperature Tg of said polymer is from 0° C. to 110° C.

45. A process according to claim 44, wherein the glass transition temperature Tg of said polymer is from 40° C. to 110° C.

46. A process according to claim 7, wherein polymer (P) is present in the form of an aqueous dispersion having a solids content of from 10% to 50% by weight.

47. A process according to claim 46, wherein said solids content is from 20% to 40% by weight.

48. A process according to claim 7, wherein said polymer (P) is present in a proportion of from 0.05% to 50% in solid form of the weight of said cleaning composition.

49. A process according to claim 8, wherein said detergent formulation for cleaning hard surfaces comprises from 0.01% to 0.5% by weight of said polymer (P), expressed as solids.

50. A process according to claim 7, wherein at least one crosslinking unit (R) is present and is derived from divinylbenzene, from ethylene glycol dimethacrylate, from allyl methacrylate, from methylenebis(acrylamide) or from glyoxalbis(acrylamide).

51. A process according to claim 8, wherein at least one crosslinking unit (R) is present and is derived from divinylbenzene, from ethylene glycol dimethacrylate, from allyl methacrylate, from methylenebis(acrylamide) or from glyoxalbis(acrylamide).

52. A process according to claim 7, wherein at least 70% of the total mass of said polymer (P) is formed from hydrophobic unit(s) (N) and wherein the hydrophilic units (F) represent not more than 30% of the total mass of the polymer (P) and the crosslinking units (R) represent not more than 20% of the total mass of the polymer (P).

53. A process according to claim 52, wherein the crosslinking units (R) represent not more than 10% of the total mass of the polymer (P).

54. A process according to claim 53, wherein the crosslinking units (R) represent not more than 5% of the total mass of the polymer (P).

55. A process according to claim 13, wherein the average size of the polymer (P) particles ranges from 5 nm to 100 nm.

56. A process according to claim 55, wherein the average size of the polymer (P) particles ranges from 10 nm to 50 nm.

57. A process according to claim 13, wherein said polymer (P) has a glass transition temperature Tg of from −40° C. to 150° C., and remains insoluble under the working conditions of said composition.

58. A process according to claim 57, wherein the glass transition temperature Tg of said polymer is from 0° C. to 110° C.

59. A process according to claim 58, wherein the glass transition temperature Tg of said polymer is from 40° C. to 110° C.

60. A process according to claim 55, wherein said polymer (P) has a glass transition temperature Tg of from −40° C. to 150° C., and remains insoluble under the working conditions of said composition.

61. A process according to claim 60, wherein the glass transition temperature Tg of said polymer is from 0° C. to 110° C.

62. A process according to claim 61, wherein the glass transition temperature Tg of said polymer is from 40° C. to 110° C.

63. A process according to claim 56, wherein said polymer (P) has a glass transition temperature Tg of from −40° C. to 150° C., and remains insoluble under the working conditions of said composition.

64. A process according to claim 63, wherein the glass transition temperature Tg of said polymer is from 0° C. to 110° C.

65. A process according to claim 64, wherein the glass transition temperature Tg of said polymer is from 40° C. to 110° C.

66. A process according to claim 13, wherein polymer (P) is present in the form of an aqueous dispersion having a solids content of from 10% to 50% by weight.

67. A process according to claim 66, wherein said solids content is from 20% to 40% by weight.

68. A process according to claim 13, wherein said polymer (P) is present in a proportion of from 0.05% to 50% in solid form of the weight of said cleaning composition.

69. A process according to claim 14, wherein said detergent formulation for cleaning hard surfaces comprising from 0.01% to 0.5% by weight of said polymer (P), expressed as solids.

70. A process according to claim 13, wherein at least one crosslinking unit (R) is present and is derived from divinylbenzene, from ethylene glycol dimethacrylate, from allyl methacrylate, from methylenebis(acrylamide) or from glyoxalbis(acrylamide).

71. A process according to claim 14, wherein at least one crosslinking unit (R) is present and is derived from divinylbenzene, from ethylene glycol dimethacrylate, from allyl methacrylate, from methylenebis(acrylamide) or from glyoxalbis(acrylamide).

72. A process according to claim 13, wherein at least 70% of the total mass of said polymer (P) is formed from hydrophobic unit(s) (N) and wherein the hydrophilic units (F) represent not more than 30% of the total mass of the polymer (P) and the crosslinking units (R) represent not more than 20% of the total mass of the polymer (P).

73. A process according to claim 72, wherein the crosslinking units (R) represent not more than 10% of the total mass of the polymer (P).

74. A process according to claim 72, wherein the crosslinking units (R) represent not more than 5% of the total mass of the polymer (P).

* * * * *